United States Patent [19]

Van Etten

[11] 4,406,259

[45] Sep. 27, 1983

[54] ADAPTER PLATE FOR THE CONVERSION OF A 4-BARREL CARBURETOR TO A 2-BARREL CONFIGURATION

[76] Inventor: Richard C. Van Etten, R.D. 1, Beaver Dams, N.Y. 14812

[21] Appl. No.: 353,322

[22] Filed: Mar. 1, 1982

Related U.S. Application Data

[63] Continuation of Ser. No. 92,370, Nov. 9, 1981, abandoned.

[51] Int. Cl.[3] ..... F02B 77/00

[52] U.S. Cl. ..... 123/198 R; 123/1 R; 123/DIG. 7; 261/23 A

[58] Field of Search ..... 123/198 R, 1 R, 198 F, 123/DIG. 1, DIG. 6, DIG. 7; 261/23 A

[56] References Cited

U.S. PATENT DOCUMENTS

| | | | |
|---|---|---|---|
| 2,193,533 | 3/1940 | Kishline | 261/23 A |
| 3,114,669 | 12/1963 | Herbest | 261/23 A |
| 4,096,845 | 6/1978 | Holmes | 123/198 F |

*Primary Examiner*—Ira S. Lazarus

*Attorney, Agent, or Firm*—Gerhard K. Adam

[57] ABSTRACT

An adapter plate readily converts a 4-barrel carburetor to a 2-barrel configuration without disconnecting throttle linkages or requiring major adjustment of the combustion system of an internal combustion engine.

7 Claims, 4 Drawing Figures

ADAPTER PLATE FOR THE CONVERSION OF A 4-BARREL CARBURETOR TO A 2-BARREL CONFIGURATION

This application is a continuation, of application Ser. No. 092,370, filed Nov. 9, 1981, now abandoned.

BACKGROUND OF THE INVENTION

1. Field of the Invention

This invention relates to 4-barrel carburetors for gasoline engines for motor vehicles and in particular to an adapter plate means for easy conversion of a 4-barrel carburetor to and from 2-barrel operation only.

2. Description of the Prior Art 4-barrel carburetors have been provided for gasoline engines to enable one to have power and/or speed as required. The primary carburetor portion provides for normal power and speed for driving about town. The secondary carburetor portion provides for added power and speed needed for express highway traveling at steady high speeds and bursts of speed to go around traffic. However, in everyday city travel driver's driving habits cause the secondary carburetor portions to be activated and consequently gasoline is wasted and the gas mileage rating of the motor vehicle is lowered.

Adapters are available commercially for converting engines and carburetors from 4-barrel to 2-barrel configurations. However, this presents a problem as one has to disconnect carburetor linkages and physically change from a 4-barrel configuration to a 2-barrel configuration and vice versa as required for the vehicle's intended use. Each change requires at least a minor tune-up of the engine to ensure efficient engine performance.

It is an object of this invention to provide a new and improved adapter means for converting a 4-barrel carburetor to a 2-barrel carburetor.

Another object of this invention is to provide a new and improved adapter means for converting a 4-barrel carburetor to a 2-barrel carburetor without disconnecting and reconnecting throttle linkages or requiring an extensive motor tune-up after the conversion.

Other objects of this invention will, in part, be obvious and will, in part, appear hereinafter.

BRIEF DESCRIPTION OF THE INVENTION

In accordance with the teachings of this invention there is provided an adapter plate for readily converting a 4-barrel carburetor to a 2-barrel carburetor configuration and vice versa without requiring a major tune-up or physical replacement of one carburetor with another carburetor.

The adapter plate is inserted between the 4-barrel carburetor and the intake manifold of the internal combustion engine and tightened in place. The adapter plate has two opposed major surfaces which are the top and bottom surfaces thereof. Walls define 4 spaced apertures which extend entirely through the plate in the outer peripheral portion for assembling the plate to the manifold and the carburetor. Another pair of walls define two spaced apertures extending entirely through the plate, and each aperture has a center which is substantially coincidental with the longitudinal axis of the respective primary barrel and aligned with the aperture. Two spaced depressed regions are formed in the top surface of the plate and project beyond the bottom surface of the plate. Each spaced depressed region has a center substantially coincidental with the longitudinal axis of one of the two secondary barrels of the carburetor. Each depressed region is configured to provide complete freedom of movement of the secondary throttle valve of the secondary barrel associated therewith.

The adapter plate is easily inserted and removed from between the carburetor and the intake manifold. The throttle linkages do not have to be disconnected. The engine requires, at the most, a minor adjustment when the plate is inserted or removed.

DESCRIPTION OF THE INVENTION

Figure 1:
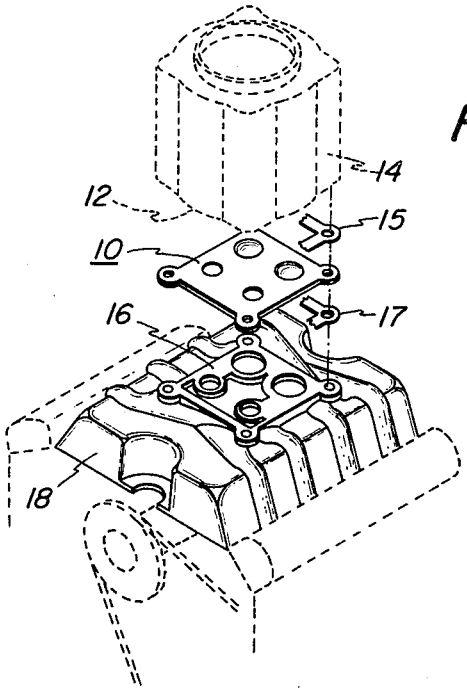
FIG. 1 is a schematic view of an adapter plate with respect to a carburetor and an intake manifold.
Figure 2:
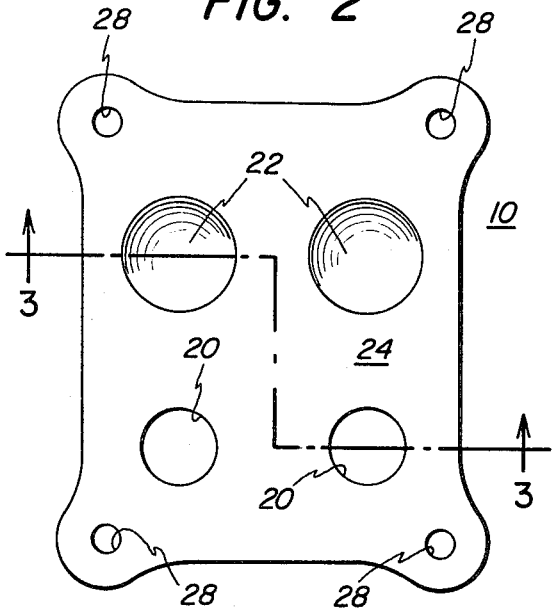
FIG. 2 is a top planar view of an adapter plate.
Figure 3:
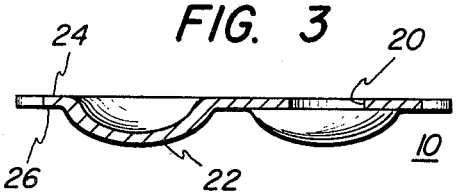
FIG. 3 is a side elevation view, partly in cross-section, of the adapter plate of FIG. 2 taken along the cutting plane 3–3'.

With reference to FIGS. 1, 2 and 3, there is shown an adapter plate 10 suitable for insertion between the bottom 12 of a 4-barrel carburetor 14 and the inlet manifold 16 of an internal combustion engine 18. Gaskets 15 and 17 provide good sealing means between the assembled components for efficient use of the carburetor. Preferably, each gasket is of the perimeter type.

The adapter plate 10 is made of a suitable material which will withstand the normal operating temperatures of the engine 18 without excessive corrosion. Excessive corrosion of the plate 10 may produce corrosion products which could inhibit the proper operation of the combustion system of the engine 18. One suitable material is stainless steel of either the 300 or 400 type series. Another material is galvanized steel.

Walls 20 define speed apertures which extend entirely through the thickness of the plate 10. The center of each aperture is substantially coincidental with the centerline of a respective barrel of the primary portion of the 4-barrel carburetor 14. The plate 10 is configured to form two spaced depressed regions 22 in the top surface 24 of the plate 10 which extend below surface 20 thereof. The center of each depressed region 22 is substantially coincidental with the centerline of a respective secondary barrel of the carburetor 14. The depressed region 22 is configured to provide for complete freedom of the secondary throttle valve of the respective secondary barrel. Walls 28 define from spaced apertures extending entirely through the outer peripheral portion of the plate 10 for assembly of the plate 10 to the carburetor 14 and the manifold 16.

Insertion of the plate 10 is easily accomplished by removal of the 4 bolts securing the carburetor 14 to the inlet manifold 16 of the engine 18. The plate 10 is inserted between the carburetor 14 and the engine 18 and oriented such that the top surface 24 will be in an abutting relationship with the surface 12 of carburetor 14 and the bottom surface 26 is in an abutting relationship with the surface of the inlet manifold 16. The throttle linkages to the carburetor do not have to be removed. Therefore after bolting the carburetor 14 and plate 10 to the inlet manifold 16, no reconnecting of linkages are required and a minimum, if any, returning of the engine is required. Preferably, gaskets 15 and 17 are inserted on either side of plate 10.

The depressed regions 22 block the openings of the secondary barrels to the inlet manifold 16 and engine 18. Therefore, any operation of the motor vehicle in which the engine 18 is installed which would normally cause the operation of the secondary barrels of carburetor 14 is negated. The vacuum, which normally is experienced to cause the operation of the secondary barrels by either a vacuum operated diaphragm or in conjunction with a mechanical linkage to the primary barrels, cannot be sensed by the carburetor 14 since the regions 22 block the opening of the secondary barrels to the engine 18.

By reversing the assembly steps described heretofore the plate is easily removed from the engine 18 and reconverts the carburetor 14 to 4-barrel operation.

Thus, employing this plate 10, a 4-barrel carburetor 14 has easily been converted to solely a 2-barrel carburetor configuration for normal city and town driving thereby providing excellent gas conservation means and correction of poor driving habits of the operator. It is to be noted that the same carburetor is used at all times. One does not have to maintain individual 2-barrel and 4-barrel carburetors for conversion purposes. Additionally, since the throttle linkages are not disturbed during the conversion processes, no major adjustments to engine tunn-up is required after each conversion.

The success of the plate 10 has been demonstrated in the operation of several vehicles. The average miles per gallon for city driving for a 1969 Chevrolet truck having a 4-barrel carburetor and a 350 cubic inch engine was 11 miles per gallon before conversion. Upon insertion of an adapter plate converting the 4-barrel carburetor to a 2-barrel configuration, the truck achieved an average of 12.1 miles per gallon in city driving, the increase in efficiency was 9.1 percent.

Similar operation in the city of a 1968 Oldsmobile sedan, 455 cubic inch engine, improved the average gasoline consumption from 11 miles per gallon to 18 miles per gallon for an improvement of 63 percent. The average gasoline comsumption for city driving of a 1972 Pontiac sedan (Grand Prix Model), 455 cubic inch engine, was improved from less than 10 miles per gallon to greater than 14 miles per gallon.

Figure 4:
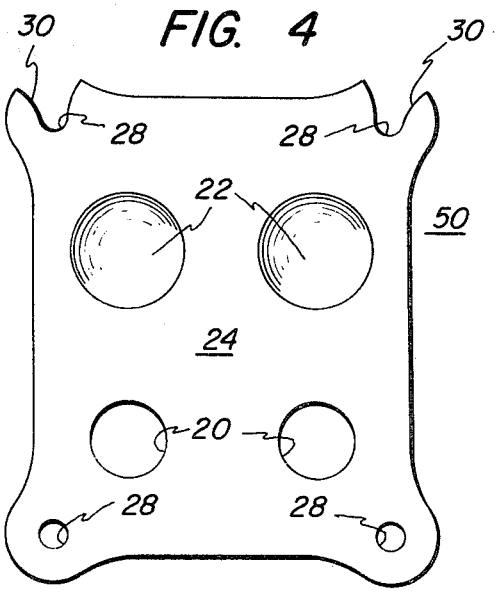
FIG. 4 is a top planar view of another embodiment of an adapter plate.

With reference to FIG. 4, the plate 10 may be modified by removing two corners thereof to provide a slot 30 at each of the corners. The gaskets 15 and 17 are modified in the same manner also. One need only entirely remove two mounting bolts to insert or remove the modified adapter plate 50. The other two mounting bolts only have to be loosened enough to permit the insertion or the removal of the plate 50 and gaskets 15 and 17 from between the carburetor 14 and the manifold 16. The plate 10 has a thickness of from 1/16 inch to 3/16 inch or more to provide sufficient strength to prevent buckling and bending when inserting and removing the plate 10 between the carburetor 10 and the manifold 16.

I claim as my invention:

1. An adapter plate for converting a 4-barrel carburetor having two primary barrels and two secondary barrels to a carburetor configuration having two primary barrels without modifying the carburetor, including the mechanical linkage thereof, or the intake manifold of an internal combustion engine to which it is affixed, the adapter plate having two opposed major surfaces which are the top and bottom surfaces thereof;

walls defining four spaced apertures extending entirely through the plate in the outer peripheral region thereof for accepting mounting means for assembly of the plate to the 4-barrel carburetor and the intake manifold;

walls defining two spaced apertures extending entirely through the plate and so aligned that the center of each aperture is substantially coincidental with the longitudinal axis of a respective one of the primary barrels of the carburetor, and two spaced depressed regions formed in the top surface of the plate and projecting beyond the bottom surface of the plate, each spaced depressed region having a center substantially coincidental with the longitudinal axis of a respective one of the two secondary barrels of the carburetor, and blocking the passageway from that barrel to a corresponding aperture in the intake aperture to negate normal operation of the secondary barrel by an internal combustion engine when attached thereto, the configuration of each spaced depressed region providing clearance for rotation of the respective secondary throttle valve of the associated secondary barrel.

2. The adapter plate of claim 1 wherein the material comprising the plate is stainless steel.

3. The adapter plate of claim 1 wherein the material comprising the plate is galvanized steel.

4. The adapter plate of claim 1 wherein the thickness of the plate is from 1/16 inch to 3/16 inch.

5. The adapter plate of claim 1 wherein a portion of the outer peripheral region of the plate is removed from the vicinity of two mutually adjacent apertures of the 4 spaced apertures to provide two spaced slots for facilitating mounting and removing of the plate.

6. An internal combustion engine including an intake manifold having an aperture formed therein;

a 4-barrel carburetor having two primary barrels and two secondary barrels attached to the intake manifold, each barrel passageway having access to an aperture of the manifold;

means for negating the operation of the two secondary barrels without blocking the passage from the two primary barrels to all of the passageways of the intake manifold, and without adjusting the mechanical linkage to the primary barrels;

the means consisting of an adapter plate having two opposed major surfaces which are the top and bottom surfaces thereof;

walls defining four spaced apertures extending entirely through the plate in the outer peripheral region thereof for accepting mounting means for assembling the plate to the 4-barrel carburetor and the intake manifold;

walls defining two spaced apertures extending entirely through the plate and so aligned that the center of each aperture is substantially coincidental with the longitudinal axis of a respective one of the two primary barrels of the carburetor and an aperture in the intake manifold to provide a continuous passage from the primary barrel to the internal combustion engine via the aperture in the manifold;

two spaced depressed regions formed in the top surface of the plate and projecting beyond the bottom surface of the plate, each spaced depressed region having a center substantially coincidental with the longitudinal axis of a corresponding one of the two secondary barrels of the carburetor, and the longitudinal axis of an aperture in the intake manifold, the configuration of each spaced region providing clearance for rotation of the respective secondary throttle valve of the associated secondary barrel, each spaced depressed region of the plate blocking entirely a passage between each secondary barrel and a corresponding aperture in the intake manifold to negate operation of the secondary barrel during operation of the internal combustion engine, and fastener means for fastening the carburetor and the plate to each other and to the manifold.

7. The internal combustion engine of claim 6 including a first gasket disposed and assembled between the top surface of the plate and the carburetor, and a second gasket disposed and assembled between the bottom surface of the plate and the intake manifold.

* * * * *